United States Patent [19]

Dupressoir et al.

[11] 4,313,122

[45] Jan. 26, 1982

[54] OPEN CAVITY RADIATING SOURCE EXCITED BY A DIPOLE

[75] Inventors: Albert Dupressoir; Claude Bloch, both of Paris, France

[73] Assignee: Thomson-CSF, Paris, France

[21] Appl. No.: 116,549

[22] Filed: Jan. 29, 1980

[30] Foreign Application Priority Data

Feb. 2, 1979 [FR] France ..... 79 02767

[51] Int. Cl.[3] ..... H01Q 9/16

[52] U.S. Cl. ..... 343/818; 343/786; 343/789

[58] Field of Search ..... 343/786, 789, 911 R, 343/911 L, 818

[56] References Cited

U.S. PATENT DOCUMENTS

| | | | |
|---|---|---|---|
| 2,632,852 | 3/1953 | Sichak | 343/772 |
| 2,719,230 | 9/1955 | Smoll et al. | 343/911 R |
| 3,413,639 | 11/1968 | Migdal | 343/911 R |
| 3,740,754 | 6/1973 | Epis | 343/789 |
| 4,183,027 | 1/1980 | Ehrenspeck | 343/789 |

*Primary Examiner*—Eli Lieberman

*Attorney, Agent, or Firm*—Karl F. Ross

[57] ABSTRACT

A microwave radiator comprises a generally cup-shaped, at least partly metallic cavity with a cylindrical wall and an open end which is bounded by an edge or rim with two diametrically opposite axial projections, in the form of acute-angled cusps or rectangular teeth, which are bisected by an axial plane perpendicular to a dipole disposed inside the cavity. The open cavity end may be covered by a dielectric radome of frustoconical or stepped cylindrical configuration.

13 Claims, 8 Drawing Figures

OPEN CAVITY RADIATING SOURCE EXCITED BY A DIPOLE

FIELD OF THE INVENTION

Our present invention relates to a radiating source with an open cavity excited by a dipole. This source operates preferably in the microwave frequency range and can be used as a primary source or as a radiating element of an antenna array.

BACKGROUND OF THE INVENTION

Among conventional types of radiating sources with an open cavity which are excited by a dipole, sources comprising open cavities of revolution are particularly favored. Such a source, having a cylindrical open cavity, is formed by a radiating dipole placed inside a cylindrical metal base of circular cross-section. Because of the excitation phenomena of certain modes and of reflection in the cavity, the radiation diagram of such a source is formed by concentric isolevel circles up to a reduction in gain of 10 dB, beyond which the circles give way to concentric ellipses. This defect of symmetry of the radiation diagram in relation to the direction of propagation limits the bandwidth of useful frequencies.

In the case of an antenna array, the establishment of an identical radiation diagram for all directions of propagation requires a circular symmetry of the radiation diagram of each elementary source of the antenna array about its axis.

OBJECT OF THE INVENTION

The object of our invention is to increase the useful bandwidth of a radiating source of the type referred to, having a radiation diagram with increased directivity and obviating the dissymmetry of prior structures.

SUMMARY OF THE INVENTION

We realize this object, in accordance with our present invention, by providing a microwave radiator whose generally cup-shaped cavity has an open end bounded by an edge with two diametrically opposite axial projections that are bisected by a plane which includes the axis of the cylindrical wall and is perpendicular to a diametrically extending dipole inside the cavity. We may provide the cavity with a dielectric radome rising from its open end with progressively decreasing diameter and wall thickness.

In an advantageous embodiment, the edge forming the cavity rim lies in two intersecting oblique planes of a dihedral which are symmetrical about the axial plane bisecting the projections, the latter being cusps defined by the intersection of the two oblique planes.

It is, however, also possible to design the two projections as teeth of generally rectangular shape.

A plurality of such radiators may be disposed in a circularly symmetrical array, with their dipoles parallel to one another, to form an antenna of high directivity.

BRIEF DESCRIPTION OF THE DRAWING

The above and other features of our present invention will now be described in detail with reference to the accompanying drawing in which.

SPECIFIC DESCRIPTION

Figure 1:
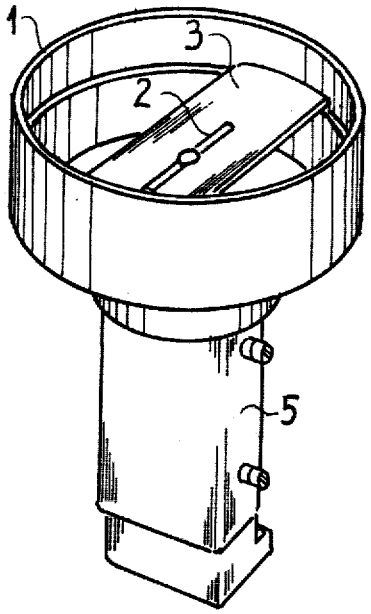
FIG. 1 is a perspective view of a radiating source of the prior art.

FIG. 1 shows an open-cavity radiating source 1 of the prior art, made from metal and cylindrical in form, excited by a quarter-wave dipole 2 built on a printed circuit 3, the unit being connected to a conventional supply system 5.

Figure 2:
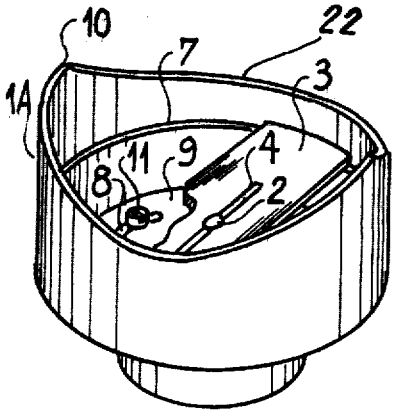
PRIOR ART FIG 2
FIGS. 2 and 3 are similar views of radiating sources in accordance with the invention.

FIG. 2 shows a view, from the radiation-emitting side, of a radiating source 1A in accordance with the invention.

Our improved radiator 1A comprises a cylindrical metal cavity open on the emission side. The cavity opening is bounded by an edge 22 defined by the intersection of its cylindrical wall with a dihedral, i.e. with two oblique planes which include an acute angle with each other and are symmetrical about an axial plane of the cavity normal to another axial plane containing the two stems 4 of dipole 2; the bicuspid edge or rim 22 has a pair of diametrically opposite cusps 10 whose flanks converge at that acute angle. The stems 4 of radiating dipole 2 are obtained by photo-etching on a dielectric wafer constituting the printed circuit 3. For reasons of mechanical strength, a cylindrical dielectric reinforcing ring 7 is disposed inside the cylindrical cavity wall and is spaced from its rim 22. In order to secure the cavity to its supply circuit and to orient the dipole in the chosen radiation direction, two slots 8 traversed by screws 11 are provided in the closed bottom 9 of the cup-shaped cavity. As shown, edge 22 has low points in line with dipole 2.

In order to obtain substantially total coupling with the outer medium, the impedance of the cavity is matched to the impedance of the air, thus permitting substantially the entire energy to be radiated outward.

Figure 3:
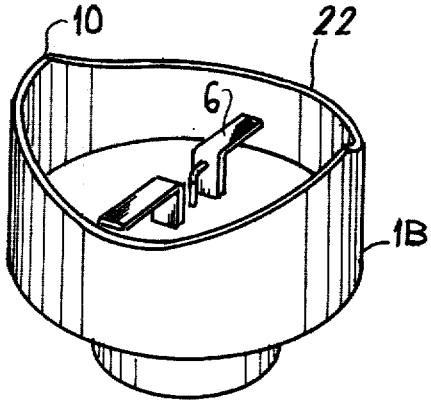

FIG. 3 shows another embodiment of our invention, comprising a radiator 1B provided with a conventional half-wave or full-wave radiating dipole 6.

The described structure brings about a widening of the operating band of the radiating source. This widening is obtained, on the one hand, by means of an improvement in the symmetry of the radiation diagram in relation to the direction of propagation and, on the other hand, by an increase in the directivity of this diagram. The symmetry of the radiation diagram of the source is improved by the opening of the cavity with bicuspid rim. The increase in directivity is obtained by adding a hollow dielectric cover or radome above the opening of the cavity.

Figure 4:
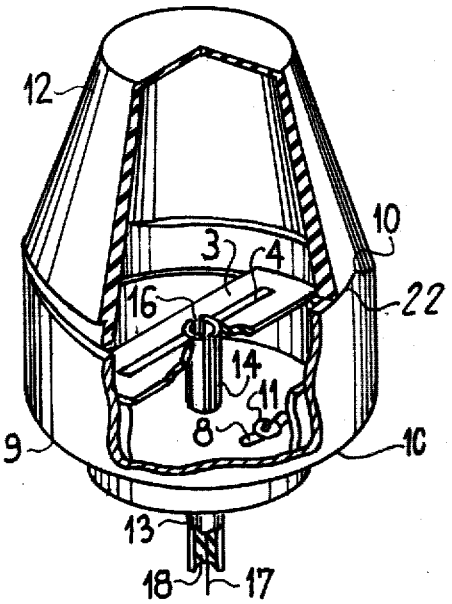
FIGS. 4, 5 and 6 are perspective views, with parts cut away, of three radiating sources according to our invention each equipped with a cover or radome.

FIG. 4 shows, with parts cut away, such a radome-covered source 1C. The radiator proper is shrouded by a hollow frustoconical cover 12 of dielectric material converging at an acute vertex angle in the direction of propagation of the emitted radiation, the cover or radome matingly engaging the cusps or projections 10. The thickness of the cover wall decreases in this same direction of propagation. The cavity is supplied along its axis of symmetry by means of a coaxial line 13. The matching of the cavity to supply line 13 is provided by means of a quarter-wave transformer and balancer formed by a quarter-wave coaxial line 14 on the outer conductor which has two portions 16 bare of metallization. The bare portions 16, symmetrical in relation to the axis of the cavity, are separated by a plane normal to the axial plane which includes the stems 4 of the dipole deposited by photo-etching on wafer 3. The central conductor 17 of the coaxial line is a metal wire sheathed with a dielectric 18. To complete the tuning, a low-impedance ring not shown in the Figure may be placed against the external wall of the coaxial line.

Figure 5:
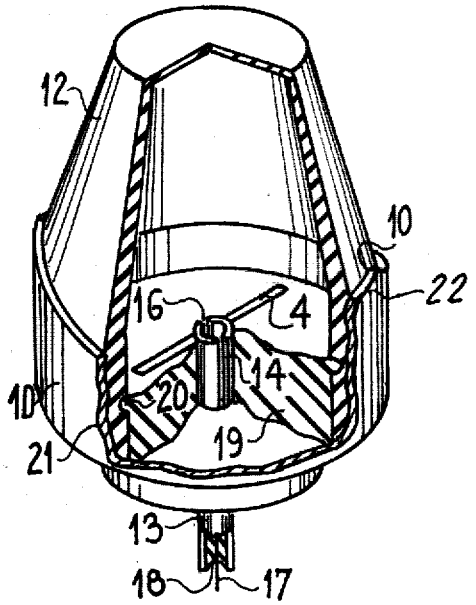

FIG. 5 is a view, similar to that of FIG. 4, of another radiating source 1D in accordance with our invention having a metallized dielectric cylindrical base 19. The metallic layer 21 overlying the dielectric body of base 19 is produced by photo-etching and also surrounds a cylindrical lower part of cover 12 interfitted with the base by means of a tongue-and-groove joint 20. The stems 4 of the dipole are deposited by photo-etching on the dielectric base 19.

This embodiment of our invention with a metallized dielectric base has the advantage of being less expensive, especially for the construction of a large number of radiators. The electromagnetic performances are the same as with a radiator having an all-metal cavity wall.

Figure 6:
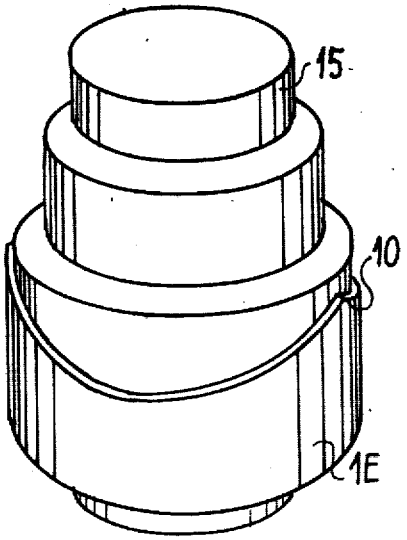

FIG. 6 shows yet another embodiment of our invention comprising a radiating source 1E with a hollow dielectric cover 15 of stepped configuration made from cylindrical coaxial sections of decreasing diameters in the propagation direction of the emitted radiation. These sections differ in height and their wall thickness also decreases in the propagation direction.

Figure 7:
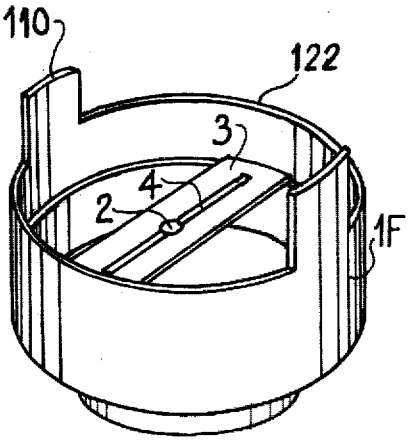
FIG. 7 is a perspective view of yet a further embodiment of our invention.

FIG. 7 shows yet another embodiment of the invention, comprising a radiator 1F whose open cavity has two symmetrical opposite teeth 110 at a diameter perpendicular to stems 4 of dipole 2. The cavity of radiator 1F may be made entirely from metal or from a metallized dielectric as described above with reference to FIG. 5. In this instance, the cavity edge 122 lies in a single plane perpendicular to the axis.

As an example of construction of a radiating source in accordance with our invention, operating in frequency band C, i.e. from 5450 to 5850 MHz, the average dimensions are the following: diameter of the cavity between 1 and 3 wavelengths $\lambda$ depending on the type of dipole used; height above the base equal to half a wavelength; optimum height of the cusps equal to $\lambda/5$. In the case of the construction of a source having two rectangular projections such as the teeth 110 of FIG. 7, operating in the same frequency range as above, the width of the projections is $\lambda/2$ and their height is $\lambda/10$. For a radiating source operating at other frequencies, the dimensions are similar to those given above.

An interesting application of this type of radiating source is its use in antenna arrays, particularly circularly symmetrical groupings. An increase in the directivity of an antenna array is obtained by increasing the individual directivity of its constituent elementary sources. In fact, the radiation diagram of the antenna array is obtained by multiplying the radiation diagram of an elementary source of the array by the array function.

Figure 8:
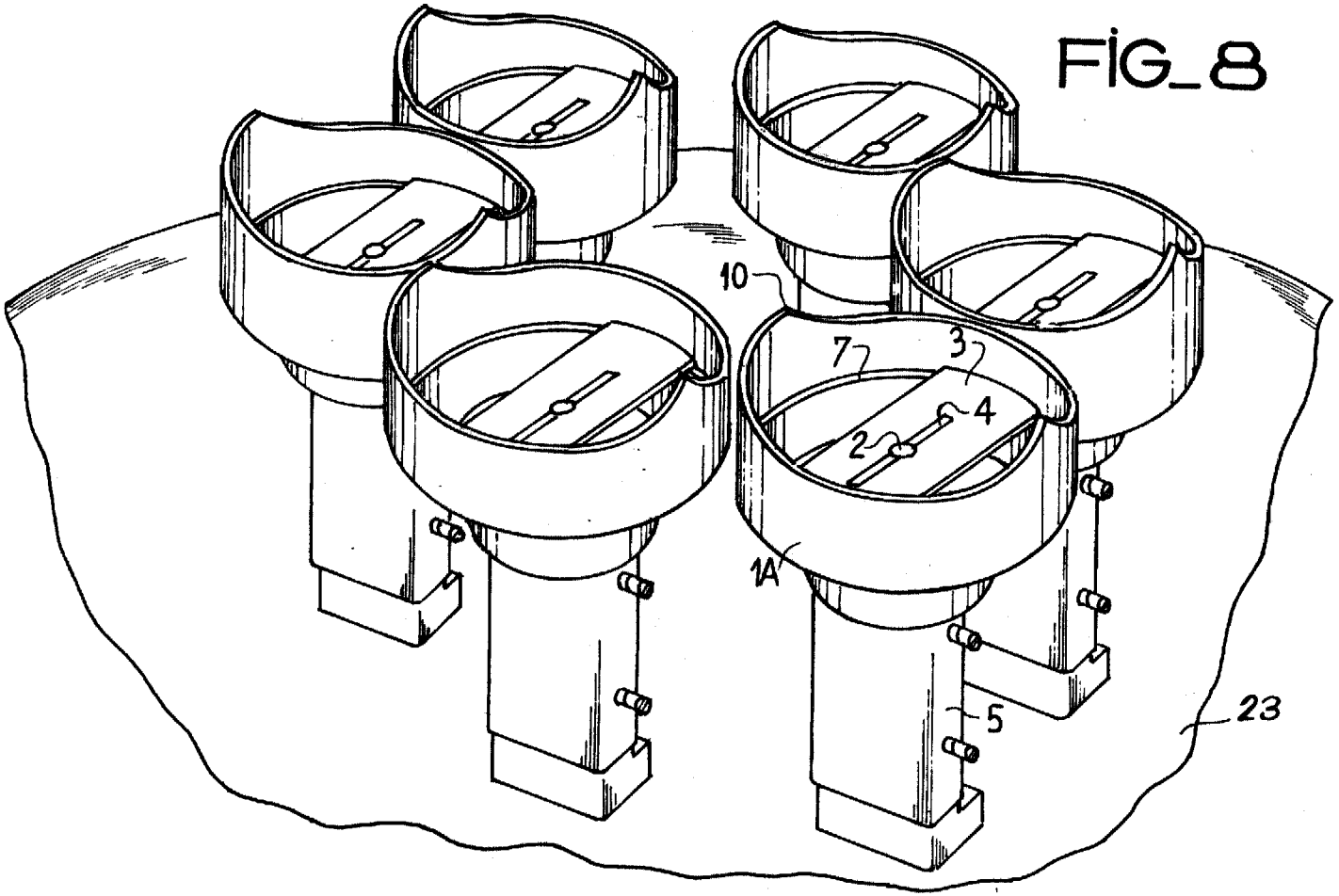
FIG. 8 is a perspective view of an antenna array formed from radiating sources corresponding to the embodiment of FIG. 2.

FIG. 8 shows schematically one example of such an antenna array whose elementary sources are of the type shown at 1A in FIG. 2. They are disposed in a circle on a metallic support 23. All the dipoles 2 are oriented in the same direction which is that of the polarization of the antenna.

What is claimed is:

1. A microwave radiator comprising:

a generally cup-shaped cavity with a cylindrical peripheral metal wall centered on an axis and an open end bounded by an edge with two diametrically opposite axial projections; and a diametrically extending dipole in said cavity, said projections being bisected by an axial plane perpendicular to said dipole.

2. A radiator as defined in claim 1 wherein said edge lies in two intersecting oblique planes of a dihedral which are symmetrical about said axial plane, said projections being cusps defined by the intersection of said oblique planes.

3. A radiator as defined in claim 2 wherein said oblique planes include an acute angle with each other.

4. A radiator as defined in claim 2 or 3 wherein said cusps have a height of substantially one-fifth of the operating wavelength.

5. A radiator as defined in claim 1 wherein said projections are teeth of generally rectangular shape.

6. A radiator as defined in claim 5 wherein said teeth have a width of substantially half the operating wavelength and a height of substantially one-tenth of said wavelength.

7. A radiator as defined in claim 1 or 2 wherein said cavity is covered by a dielectric radome rising from said open end with progressively decreasing diameter and wall thickness.

8. A radiator as defined in claim 7 wherein said radome is of frustoconical shape.

9. A radiator as defined in claim 7 wherein said radome is of stepped cylindrical shape.

10. A radiator as defined in claim 7 wherein said cavity has a dielectric base, said peripheral wall being a metallic layer overlying said base and surrounding an adjoining part of said radome interfitted with said base.

11. A radiator as defined in claim 1 or 2 wherein said peripheral wall is metallic and is internally provided with a dielectric reinforcing ring spaced from said edge.

12. A radiator as defined in claim 1 wherein said dipole is of quarter wavelength.

13. An antenna comprising a plurality of radiators as defined in claim 1 or 2 disposed in a circularly symmetrical array with their dipoles parallel to one another.

* * * * *